United States Patent [19]

Bentley

[11] Patent Number: 4,610,205

[45] Date of Patent: Sep. 9, 1986

[54] BULLET FOR BLACK POWDER RIFLES

[76] Inventor: John C. Bentley, 128-D Watson Dr., Turtle Creek, Pa. 15145

[21] Appl. No.: 635,733

[22] Filed: Jul. 30, 1984

[51] Int. Cl.[4] ..... F42B 9/20; F42B 31/00

[52] U.S. Cl. ..... 102/529; 102/501; 102/524

[58] Field of Search ..... 102/501, 524–528, 102/529, 442; 42/1 BC

[56] References Cited

U.S. PATENT DOCUMENTS

| | | | |
|---|---|---|---|
| 143,419 | 10/1873 | Rein et al. | 102/524 |
| 245,994 | 8/1881 | Carr . | |
| 326,231 | 9/1885 | Manning . | |
| 634,383 | 10/1899 | Webley . | |
| 816,577 | 4/1906 | Haase . | |
| 996,820 | 4/1911 | Wray . | |
| 1,072,880 | 9/1913 | Tewes . | |
| 1,081,065 | 12/1913 | Starkweather . | |
| 1,201,935 | 10/1916 | Campbell . | |
| 2,234,165 | 3/1941 | Hatcher et al. . | |
| 2,863,130 | 7/1959 | Gulley et al. . | |
| 3,049,998 | 8/1962 | Brown . | |
| 3,613,596 | 10/1971 | Wadle . | |
| 3,918,364 | 11/1975 | Duer . | |

FOREIGN PATENT DOCUMENTS

| | | | |
|---|---|---|---|
| 24404 | 7/1922 | France | 102/501 |
| 29354 | 7/1925 | France | 102/501 |

OTHER PUBLICATIONS

Army Ordnance "Styles in Small Arms Projectiles" by Green May–Jun., 1932, 395–401.

*Primary Examiner*—Harold J. Tudor
*Attorney, Agent, or Firm*—John B. Sotak

[57] ABSTRACT

A bullet for muzzle loading black powder rifles having an elongated cylindrical metal body. The metal body includes a front paraboloidal segment and a recessed base. A rear expansion band for initially guiding the bullet into the rifled bore and for tightly sealing the explosive gases upon firing of the rifle. A front rifling band which is cut by the lands of the rifling to cause rotation about the longitudinal axis of the bullet. An intermediate knife-like cleaning band which removes residue from the rifled bore as the bullet is propelled outwardly by the explosive gases.

20 Claims, 4 Drawing Figures

BULLET FOR BLACK POWDER RIFLES

FIELD OF THE INVENTION

This invention relates to a bullet or projectile for black powder guns and, more particularly, to a casted bullet including an elongated cylindrical body portion having a forward rifling band, an intermediate cleaning band, and a rearward expanding band, and having a hollow base which, upon firing, expands the intermediate cleaning band and the rearward expanding band to clean the rifled bore and to stabilize the bullet as it travels along the length of the barrel.

BACKGROUND OF THE INVENTION

With the revitalized interest in black powder shooting and hunting, there arose a need to improve the common and original patch and ball bullet loading and firing of percussion or flintlock rifles and muskets. The patched round ball bullets are the slowest to reload and are the least accurate. Further, the fouling of the black powder necessitates frequent swabbing and cleaning of the bore of the rifle. An attempt to alleviate the shortcomings of the round ball bullets resulted in the development of the minie and maxi balls. These cylindrical-body conical-headed bullets made it possible to obtain a heavier load for any given caliber which usually improved the accuracy. But, the fouling by the black powder propellent remained an annoying problem, which required the shooter to frequently swab and clean the bore of the rifle. Further, it is not uncommon for minie and maxi bullets to become jammed in the bores of the muzzle loaders. For example, during the excitement of competitive shooting, or after missing a deer on a first shot, it is not unusual to get the next bullet stuck in the bore, due to the fouling or the like. In one instance, the ramrod was broken in an attempt to free a jammed maxi ball from the bore of a flintlock rifle.

OBJECTS OF THE INVENTION

Accordingly, it is an object of this invention to provide a new and improved bullet for black powder guns.

Another object of this invention is to provide a unique cast metal bullet which cleans the bore of a muzzle loading rifle upon discharge.

A further object of this invention is to provide a hollow based bullet which includes a rifling band, a cleaning band, and an expansion band for sealing, cleaning, and stabilization during the firing of a black powder rifle.

Still another object of this invention is to provide a multiple band lead projectile which reduces jamming during reloading and which cleans the bore upon discharge of the rifle.

Still a further object of this invention is to provide a flat-nosed hollow based slug which is stabilized by a front rifling band, and having a rear expansion band which is dilated upon discharge of a black powder gun.

Still another object of this invention is to provide a molded lead bullet which is readily loaded into the muzzle of a black powder rifle and which cleans the bore of residue upon firing, and is more stable and accurate during flight.

Yet a further object of this invention is to provide an improved bullet for black powder muzzle loaders which results in easier loading, requires less swabbing between shots and achieves greater accuracy during shooting.

An additional object of this invention is to provide a bullet for a rifled bore muzzle loader comprising an elongated cylindrical body having a front rifling band, an intermediate cleaning band, and a rear expansion band, and said elongated cylindrical body having a recessed base which results in the dilation of said intermediate cleaning band and said rear expansion band to clean the rifled bore and to stabilize the bullet.

Yet an additional object of this invention is to provide a projectile for black powder rifles comprising a metal body having a rounded blunt front end, a cavity formed in the base of the metal body, an expansion ring formed on the rearward portion of the metal body, a cleaning ring formed on the intermediate portion of the metal body, and an enlarged rifling ring formed on the forward portion of the metal body, said expansion ring engaging the lands of the rifling when initially inserted into the bore to guide the projectile, said rifling ring is cut by the lands of the rifling as the projectile is urged toward its seat in the rifle, and said cavity in the base being expanded upon detonation of the charge to distend the cleaning and expansion rings against the grooves and lands of the rifling to form a tight seal and to clean the bore as the projectile is propelled outwardly and to stabilize the projectile upon exiting the bore.

SUMMARY OF THE INVENTION

Briefly, in accordance with the invention, there is provided a soft metal bullet for black powder nuzzle loading rifles. The metal bullet includes an elongated cylindrical body having a blunt rounded front portion and a recessed base portion. A front rifling band having a diameter which is substantially equal to the grooves of the rifling so that lands of the rifling cut the rifling band as the bullet is pushed into the bore of the rifle. A rear expansion band formed at the extremity of the recessed base portion and having a diameter substantially equal to the diameter of the lands of the rifling which enhances placement and guidance of the bullet during loading. An intermediate cleaning band formed adjacent the rear expansion band about the recessed base portion and having a diameter substantially equal to the diameter of the lands of the rifling. Upon ignition of the powder charge, the explosive force causes the dilation of the recessed base portion so that the expansion and cleaning bands are forced against the lands and into the grooves of the rifling to provide a tight seal to prevent blow-by and to clean the bore and stabilize the bullet during discharge.

BRIEF DESCRIPTION OF THE DRAWINGS

The foregoing objects and other attendant features and advantages of the subject invention will become more fully evident from the following detailed description when considered in conjunction with the accompanying drawings wherein.

DETAILED DESCRIPTION OF THE INVENTION

Figure 1:
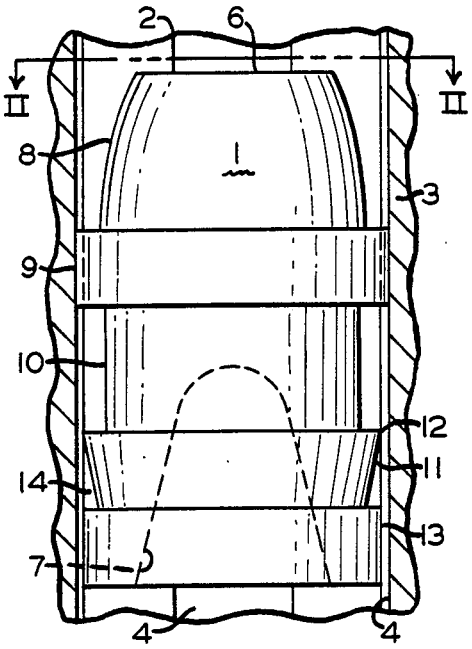
FIG. 1 is a view partly in section and partly in elevation of a molded lead bullet and a part of the barrel of a muzzle loading rifle prior to firing.
Figure 2:
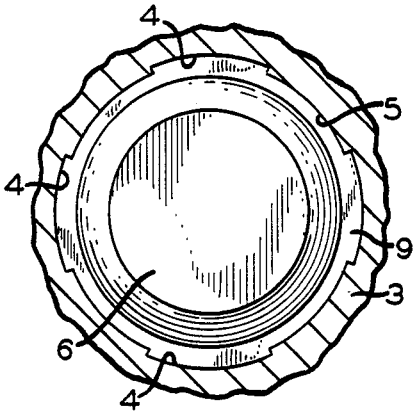
FIG. 2 is a front end sectional view taken along line II—II of the bullet and barrel of FIG. 1.

Referring now to the drawings and, in particular, to FIG. 1, there is shown a metal bullet 1 which is being loaded into the barrel bore 2 of a black powder muzzle loading rifle 3. The bore of the rifle may be any one of a number of popular calibers and is rifled by spiral grooves cut into the bore of the barrel. Thus, the internal surface of the bore 2 includes a plurality of grooves 4 and lands 5 extending the length of the barrel to increase the accuracy of a fired bullet. As shown, the bullet 1 is preferably molded of lead or lead alloy to obtain the desired weight per caliber and unit length. In practice, the bullet 1 is an elongated cylindrical member having a blunt front end 6 and a hollow rear end 7. The shape of the cavity 7 takes the form of a rounded tip cone or paraboloid. The size of the paraboloidal cavity, namely, the length, diameter and taper, is dependent upon the caliber and weight of the bullet 1 and the softness of the metallic lead which dictate the amount of deformation occurring upon detonation of the black powder charge.

It will be seen that the elongated cylindrical lead bullet is provided with a plurality of bands or projecting rings along the length thereof. As shown, the front of the bullet 1 is a paraboloidal segment 8 which terminates with an enlarged front rifling band 9. The rifling band 9 has a preselected width and has a diameter width which is substantially the same as the rifling so that the lands cut into the band 9 and the outer peripheral surface engages the rifling grooves 4 when the bullet 1 is forced into the bore 2. A grease or lubricating groove 10 is formed between the front rifling band 9 and an intermediate acute angled cleaning band of annular ring 11. It will be seen that the cleaning band 11 is slightly tapered and has a sharp forward foul removing or debris cutting edge 12 which has a diameter substantially equal to the lands 5 of the bore 2. In viewing FIGS. 1, 3, and 4, there is shown a rear expanding band 13 which also has a diameter substantially equal to the lands 5 of the bore 2. The widths of the cleaning and expansion bands 11 and 13 are substantially equal to the width of the rifling band 9. As shown in FIGS. 1 and 4, a tapered groove 14 is formed between the ends of the bands 11 and 13. The groove 14 takes the form of an angled annular groove which may collect particles of debris or fouling which gets past the annular cutting edge 12 as the bullet is propelled outwardly after firing.

Let us now assume that an individual desires to load and fire the black powder rifle.

After placement of the black powder charge, a lubricated bullet 1 is placed into the open end of the barrel 3 and is pressed downwardly as far as possible into the bore by hand. It will be appreciated that the rear expansion band 13 rides on the land portions 5 to allow smooth insertion and to prevent the bullet from jamming in the bore 2. It will be seen that, as the bullet 1 continues to be pressed into the bore 2, the rifling band 9 is cut by the lands and will enter the grooves 4 to further stabilize the initial entry of the bullet. After the bullet is properly seated by an appropriate ramrod, the rifle is ready for firing.

Figure 3:
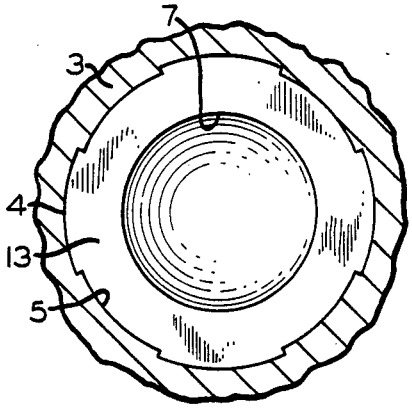
FIG. 3 is a rear end sectional view taken along line III—III of the bullet and barrel of FIG. 4.
Figure 4:
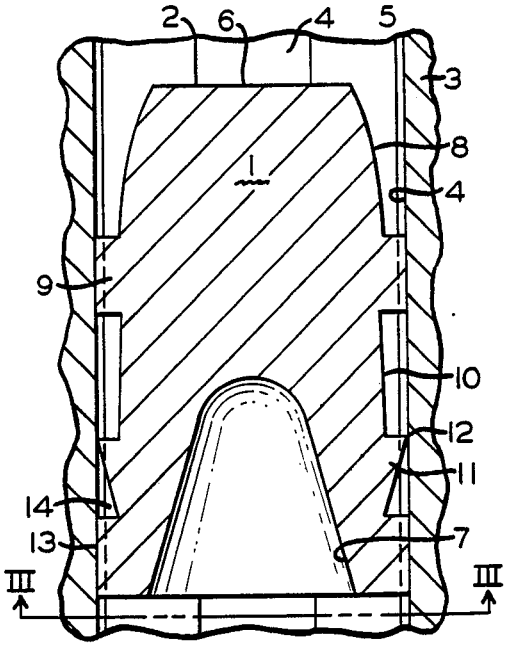
FIG. 4 is a longitudinal sectional view of the bullet and barrel after firing of the rifle.

Upon ignition of the black powder charge, the force of the detonation expands the rear hollow end 7 of the bullet 1, as shown in FIGS. 3 and 4, so that cleaning band as well as the expansion band are urged against the lands and into grooves of the bore 2. It will be seen that the apex of paraboloidal cavity extends slightly beyond the edge 12 of cleaning band 11 so that arcuate portions of bands 11 and 13 are forced into groove 5 by the explosive gases. It is enherent due to the design of the cavity that the thinner, lower wall of the expansion band 13 will distort slightly more than the thicker wall of the cleaning band 13. Thus, a tight seal is formed between the bullet and bore to prevent blow-by and to maximize the propelling force of the explosion gases. It will be appreciated that, as the bullet 1 is propelled toward the discharge end of the barrel, the forward end is stabilized by the rifling ring 9, while rearward end is stabilized by the expanded or dialated ring 13 so that the bullet uniformly spins throughout its travel through the bore 2, and the expanded rear ring 13 ensures continued spinning as the bullet exits the barrel. This mitigates the chance of the bullet from tumbling as it exits the bore 2 and thus increases the accuracy.

As mentioned above, the exploding gun powder also causes the expansion of the intermediate cleaning ring 11 so that sharp forward knife or foul removing edge 12 scrapes the lands 4 and grooves 5 as the bullet is propelled along the length of the barrel 3 to remove fouling and residue from the bore 2 and to rotate the bullet 1. Thus, the bore 2 is repeatedly cleaned during firing of each bullet so that the meantime between washing or swabbing the barrel is greatly increased. That is, during an average shooting outing or hunting trip, it is normally unnecessary to clean the bore of the rifle without experiencing any loading problems or noticing any perceptible loss in accuracy.

It will be appreciated that the foregoing description of this invention is only illustrative, and it is not intended that the invention be limited to the exact embodiment described and that various changes, modifications, alterations and equivalents within the sphere of the appended claims may be made by those skilled in the art without departing from the spirit and scope of this invention.

I claim:

1. A bullet for a rifled bore muzzle loader comprising, as elongated cylindrical body having a front rifling band having a diameter equal to the diameter of the grooves of the rifling, an intermediate cleaning band and a rear expansion band having diameters equal to the diameter of the lands of the rifling, and said elongated cylindrical body having a recessed base which extends into the bullet a distance which encompasses both intermediate cleaning band and said rear expansion band so that detonation results in the dilation of said intermediate cleaning band and said rear expansion band to clean the rifled bore and to stabilize the bullet.

2. The bullet for a rifled bore muzzle loader, as defined in claim 1, wherein said front rifling band has a diameter slightly larger than the lands of the rifled bore.

3. The bullet for a rifled bore muzzle loader, as defined in claim 1, wherein said intermediate cleaning band includes a forward knife edge for removing black powder residue from the bore.

4. The bullet for a rifled bore muzzle loader, as defined in claim 1, wherein upon detonation of the charge said expansion band is dilated to tightly engage the lands and the grooves of the rifling to enhance the stability of the bullet.

5. The bullet for a rifled bore muzzle loader as defined in claim 1, wherein said elongated cylindrical body has a flat nose.

6. The bullet for a rifled bore muzzle loader, as defined in claim 1, wherein said recessed base has a paraboloidal cavity.

7. The bullet for a rifled bore muzzle loader, as defined in claim 1, wherein said rear expanding band has a diameter substantially equal to the diameter of the lands of the bore to facilitate loading of the outlet.

8. The bullet for a rifled bore muzzle loader, as defined in claim 1, wherein said front rifling band has a diameter substantially equal to the diameter of the grooves of the rifled bore.

9. The bullet for a rifled bore muzzle loader, as defined in claim 1, wherein the detonation of the charge causes the recessed base of the bullet to expand so that said rear expansion band seals tightly against the lands and the grooves of the rifled bore.

10. The bullet for a rifled bore muzzle loader, as defined in claim 1, wherein said elongated cylindrical body includes a paraboloidal segment at its front end.

11. A projectile for black powder rifles comprising, a metal body having a rounded blunt front end, a cavity formed in the base of said metal body, an expansion ring having a diameter equal to the diameter of the lands of the rifling formed on the rearward end of said metal body, a cleaning ring having a diameter equal to the diameter of the lands of the rifling formed on the intermediate portion of said metal body, and an enlarged rifling ring having a diameter equal to the diameter of the grooves of the rifling formed on the forward end of said metal body, said expansion ring engaging the lands of the rifling when initially inserted into the bore to guide the projectile, said rifling ring is cut by the lands of the rifling as the projectile is urged toward its seat in the rifle, and said cavity in said base extends into the projectile a distance which encompasses both said cleaning ring and said expansion ring which are expanded upon detonation of the charge to distend said cleaning and expansion rings against the grooves and lands of the rifling to form a tight seal and to clean the bore as the projectile is propelled outwardly and to stabilize the projectile upon exiting the bore.

12. The projectile for black powder rifles as defined in claim 11, wherein said metal body is a molded lead bullet.

13. The projectile for black powder rifles as defined in claim 11, wherein said cleaning ring includes a knife-like cutting edge.

14. The projectile for black powder rifles as defined in claim 11, wherein said cavity formed in the base of the metal body takes the form of a paraboloid.

15. The projectile for black powder rifles as defined in claim 11, wherein said rounded blunt front end is a paraboloidal segment.

16. The projectile for black powder rifles as defined in claim 11, wherein said cleaning ring includes as acute angled annular cutting edge.

17. The projectile for black powder rifles as defined in claim 1, wherein a lubricating groove is formed between said rifling ring and said cleaning ring.

18. The projectile for black powder rifles as defined in claim 11, wherein an angled annular groove is formed between said cleaning ring and said expansion ring.

19. The projectile for black powder rifles as defined in claim 11, wherein said cleaning ring and said expansion ring surround said cavity formed in the base of the metal body.

20. A rifle bullet for a muzzle loader having a rifled bore comprising, an elongated cylindrical soft lead body having a paraboloidal segment front portion and a hollow rear portion formed by a paraboloidal cavity, a flat front rifling band having a diameter substantially equal to the diameter of the grooves of the rifling, a tapered intermediate cleaning band having a diameter substantially equal to the diameter of the lands of the rifling, a flat rear expansion band having a diameter substantially equal to the diameter of the lands of the rifling, said flat rear expansion band guides the leading end of the bullet into the rifled bore and the lands of the rifling cut said front rifling band as the bullet is driven toward its seated position, and upon firing the detonation force expands said hollow rear portion which extends into the rifle bullet a distance which encompasses both said tapered intermediate cleaning band and said flat expansion band drives said flat rear expansion band and said tapered intermediate band into the grooves of the rifling to form a tight seal to reduce blow-by of the explosive gases and to cause the scraping and cleaning of the rifled bore as the bullet travels along the rifled bore and to stabilize the bullet as it emerges from the rifled bore.

* * * * *